US006932570B2

(12) United States Patent
Heyward et al.

(10) Patent No.: US 6,932,570 B2
(45) Date of Patent: Aug. 23, 2005

(54) METHODS AND APPARATUS FOR EXTENDING GAS TURBINE ENGINE AIRFOILS USEFUL LIFE

(75) Inventors: John Peter Heyward, Loveland, OH (US); Carl Anthony Flecker, III, Loveland, OH (US); Timothy Lane Norris, Fairfield, OH (US); Todd Stephen Heffron, Indian Springs, OH (US); Roger Dale Wustman, Mason, OH (US)

(73) Assignee: General Electric Company, Schenectady, NY (US)

( * ) Notice: Subject to any disclaimer, the term of this patent is extended or adjusted under 35 U.S.C. 154(b) by 77 days.

(21) Appl. No.: 10/155,452

(22) Filed: May 23, 2002

(65) Prior Publication Data

US 2003/0219338 A1 Nov. 27, 2003

(51) Int. Cl.[7] ..... F01D 5/18

(52) U.S. Cl. ..... 416/97 R; 416/241 R; 416/248

(58) Field of Search ..... 415/115, 116; 29/889, 721; 416/96 R, 97 R, 204 A, 219 R, 239, 241 R, 241 B, 248

(56) References Cited

U.S. PATENT DOCUMENTS

| | | | | |
|---|---|---|---|---|
| 3,369,792 A | | 2/1968 | Kraimer et al. | |
| 3,606,572 A | * | 9/1971 | Schwedland | 416/96 R |
| 3,810,711 A | * | 5/1974 | Emmerson et al. | 416/97 R |
| 4,134,709 A | | 1/1979 | Eskesen | |
| 4,236,870 A | | 12/1980 | Hucul, Jr. et al. | |
| 4,390,320 A | | 6/1983 | Eiswerth | |
| 4,650,399 A | | 3/1987 | Craig et al. | |
| 4,726,104 A | | 2/1988 | Foster et al. | |
| 5,062,768 A | | 11/1991 | Marriage | |

(Continued)

FOREIGN PATENT DOCUMENTS

| | | |
|---|---|---|
| EP | 1128023 A1 | 2/2000 |
| EP | 1186680 A2 | 3/2002 |
| EP | 1234949 A2 | 8/2002 |
| EP | 1273759 A1 | 1/2003 |
| JP | 60-135606 | 7/1985 |
| JP | 11022404 A2 | 1/1999 |

*Primary Examiner*—Edward K. Look
*Assistant Examiner*—Richard A. Edgar
(74) *Attorney, Agent, or Firm*—William Scott Andes; Armstrong Teasdale LLP

(57) ABSTRACT

A method enables a gas turbine engine blade to be manufactured to include an airfoil, a platform, a shank, and a dovetail. The platform extends between the airfoil and the shank, the shank extends between the dovetail and the platform, and the dovetail includes at least one tang for securing the blade within the engine. The method comprises defining a cooling cavity in the blade that extends through the airfoil, the platform, the shank, and the dovetail, such that a portion of the cavity defined within the dovetail includes a root passage portion having a first width, and a transition portion extending between the root passage and the portion of the cavity defined within the shank, and wherein the portion of the cavity defined within the shank has a second width that is larger than the root passage first width. The blade is then coated with an environmental resistive coating.

13 Claims, 5 Drawing Sheets

U.S. PATENT DOCUMENTS

| | | | | | |
|---|---|---|---|---|---|
| 5,215,431 | A | | 6/1993 | Derrien | |
| 5,342,172 | A | | 8/1994 | Coudray et al. | |
| 5,370,499 | A | | 12/1994 | Lee | |
| 5,387,086 | A | | 2/1995 | Frey et al. | |
| 5,403,158 | A | | 4/1995 | Auxier | |
| 5,480,284 | A | | 1/1996 | Wadia et al. | |
| 5,498,133 | A | | 3/1996 | Lee | |
| 5,503,527 | A | | 4/1996 | Lee et al. | |
| 5,503,529 | A | | 4/1996 | Anselmi et al. | |
| 5,564,902 | A | | 10/1996 | Tomita | |
| 5,669,759 | A | | 9/1997 | Beabout | |
| 5,772,397 | A | | 6/1998 | Morris et al. | |
| 5,772,398 | A | | 6/1998 | Noiret et al. | |
| 5,813,836 | A | | 9/1998 | Starkweather | |
| 5,928,725 | A | | 7/1999 | Howard et al. | |
| 5,951,256 | A | * | 9/1999 | Dietrich | 416/97 R |
| 6,079,946 | A | * | 6/2000 | Suenaga et al. | 416/97 R |
| 6,132,169 | A | | 10/2000 | Manning et al. | |
| 6,174,135 | B1 | | 1/2001 | Lee | |
| 6,273,678 | B1 | * | 8/2001 | Darolia | 416/241 R |
| 6,390,774 | B1 | * | 5/2002 | Lewis et al. | 416/96 R |
| 6,474,946 | B2 | * | 11/2002 | Kildea | 416/97 R |
| 6,485,262 | B1 | * | 11/2002 | Heyward et al. | 416/97 R |

* cited by examiner

METHODS AND APPARATUS FOR EXTENDING GAS TURBINE ENGINE AIRFOILS USEFUL LIFE

BACKGROUND OF THE INVENTION

This invention relates generally to gas turbine engines, and more specifically to turbine blades used with gas turbine engines.

At least some known gas turbine engines include a core engine having, in serial flow arrangement, a high pressure compressor which compresses airflow entering the engine, a combustor which burns a mixture of fuel and air, and a turbine which includes a plurality of rotor blades that extract rotational energy from airflow exiting the combustor the burned mixture. Because the turbine is subjected to high temperature airflow exiting the combustor, turbine components are cooled to reduce thermal stresses that may be induced by the high temperature airflow.

The rotating blades include hollow airfoils that are supplied with cooling air through cooling circuits. The airfoils include a cooling cavity bounded by sidewalls that define the cooling cavity. Cooling of engine components, such as components of the high pressure turbine, is necessary due to thermal stress limitations of materials used in construction of such components. Typically, cooling air is extracted air from an outlet of the compressor and the cooling air is used to cool, for example, turbine airfoils. The cooling air, after cooling the turbine airfoils, re-enters the gas path downstream of the combustor.

At least some known turbine airfoils include cooling circuits which channel cooling air flows for cooling the airfoil. More particularly, internal cavities within the airfoil define flow paths for directing the cooling air. Such cavities may define, for example, a serpentine shaped path having multiple passes. Cooling air is directed through a root portion of the airfoil into the serpentine shaped path. In at least some known airfoil designs, an abrupt transition extends between the root portion and the airfoil portion to increase the cross-sectional area of the cooling cavity to facilitate increasing the volume of cooling air entering the airfoil portion. Because thermal stresses may be induced into the internal cavities, walls defining the cavities may be coated with a environmental coating to facilitate preventing oxidation within the cooling cavity. Because of the geometry of the cooling passages, during coating process, the coating is also deposited within the root portion of the airfoil.

To facilitate withstanding internal thermal stresses, at least some known blades are coated with a layer of environmental coating that has a thickness approximately equal to 0.001 inches. Applying the environmental coating with such a thickness prevents oxidation of the cavity walls and facilitates the airfoil withstanding thermal and mechanical stresses that may be induced within the higher operating temperature areas of the blade. However, if the coating is applied at a greater thickness, the combination of the increased thickness of the environmental coating and the abrupt transition within the dovetail may cause premature cracking in the root portion of the airfoil as stresses are induced into the transition area of the dovetail. Over time, continued operation may lead a premature failure of the blade within the engine.

BRIEF SUMMARY OF THE INVENTION

In one aspect of the invention, a method for manufacturing a blade for a gas turbine engine is provided. The blade includes an airfoil, a platform, a shank, and a dovetail, wherein the platform extends between the airfoil and the shank, the shank extends between the dovetail and the platform, and the dovetail includes at least one tang for securing the blade within the engine. The method comprises defining a cooling cavity in the blade that extends through the airfoil, the platform, the shank, and the dovetail, wherein the portion of the cavity defined within the dovetail includes a root passage portion having a first width, and a transition portion extends between the root passage and the portion of the cavity defined within the shank, and wherein the portion of the cavity defined within the shank has a second width that is larger than the root passage first width. The method also comprises coating at least a portion of an inner surface of the blade that defines the cooling cavity with a layer of an oxidation resistant environmental coating.

In another aspect a blade for a gas turbine engine is provided. The blade includes a platform, a shank extending from the platform, and a dovetail extending between an end of the blade and the shank for mounting the blade within the gas turbine engine, wherein the dovetail includes at least one tang. The blade also includes an airfoil including a first sidewall and a second sidewall extending in radial span between the platform and a blade tip, and a cooling cavity defined within the blade by the dovetail, the shank, the platform, and the airfoil, the cooling cavity including a dovetail portion defined within the dovetail, a shank portion defined within the shank and the platform, and an airfoil portion defined within the airfoil, wherein the shank portion is coupled in flow communication between the airfoil portion and the dovetail portion, the dovetail portion includes a root passage and a transition passage, the root passage including a first width, the shank portion including a second width larger than the first width, and the transition passage coupled between the root passage and the shank portion.

In a further aspect of the invention, a gas turbine engine including a plurality of blades is provided. Each blade includes an airfoil, a shank, and a platform extending therebetween. Each blade also includes a cooling cavity, and a dovetail including at least one tang configured to secure the blade within the engine. The shank extends between the platform and the dovetail, the cooling cavity is defined by the airfoil, the platform, the shank, and the dovetail, and includes a dovetail portion, a shank portion, and an airfoil portion coupled in flow communication. The dovetail portion includes a root passage including a first width, and a transition passage. The shank portion includes a second width that is larger than the root passage first width, and the transition passage is tapered between the root passage and the shank portion.

DETAILED DESCRIPTION OF THE INVENTION

Figure 1:
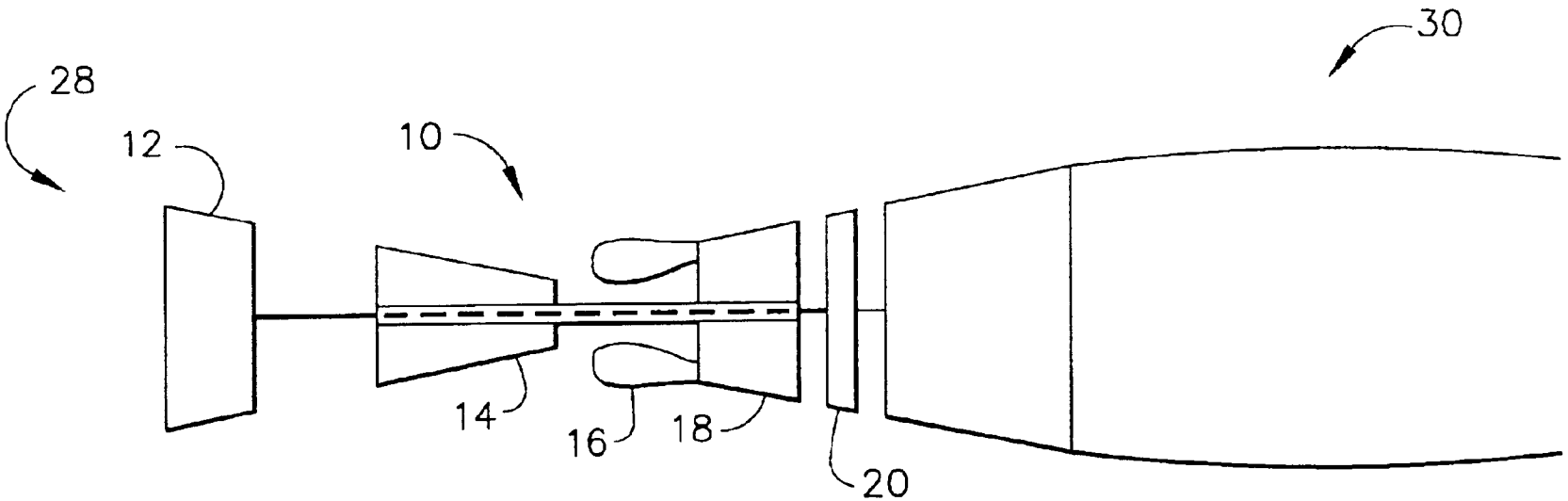
FIG. 1 is schematic illustration of a gas turbine engine.

FIG. 1 is a schematic illustration of a gas turbine engine 10 including a fan assembly 12, a high pressure compressor 14, and a combustor 16. Engine 10 also includes a high pressure turbine 18 and a low pressure turbine 20. Engine 10 has an intake side 28 and an exhaust side 30. In one embodiment, engine 10 is a CFM-56 engine commercially available from CFM International, Cincinnati, Ohio.

In operation, air flows through fan assembly 12 and compressed air is supplied to high pressure compressor 14. The highly compressed air is delivered to combustor 16. Airflow from combustor 16 drives turbines 18 and 20, and turbine 20 drives fan assembly 12. Turbine 18 drives high pressure compressor 14.

Figure 2:
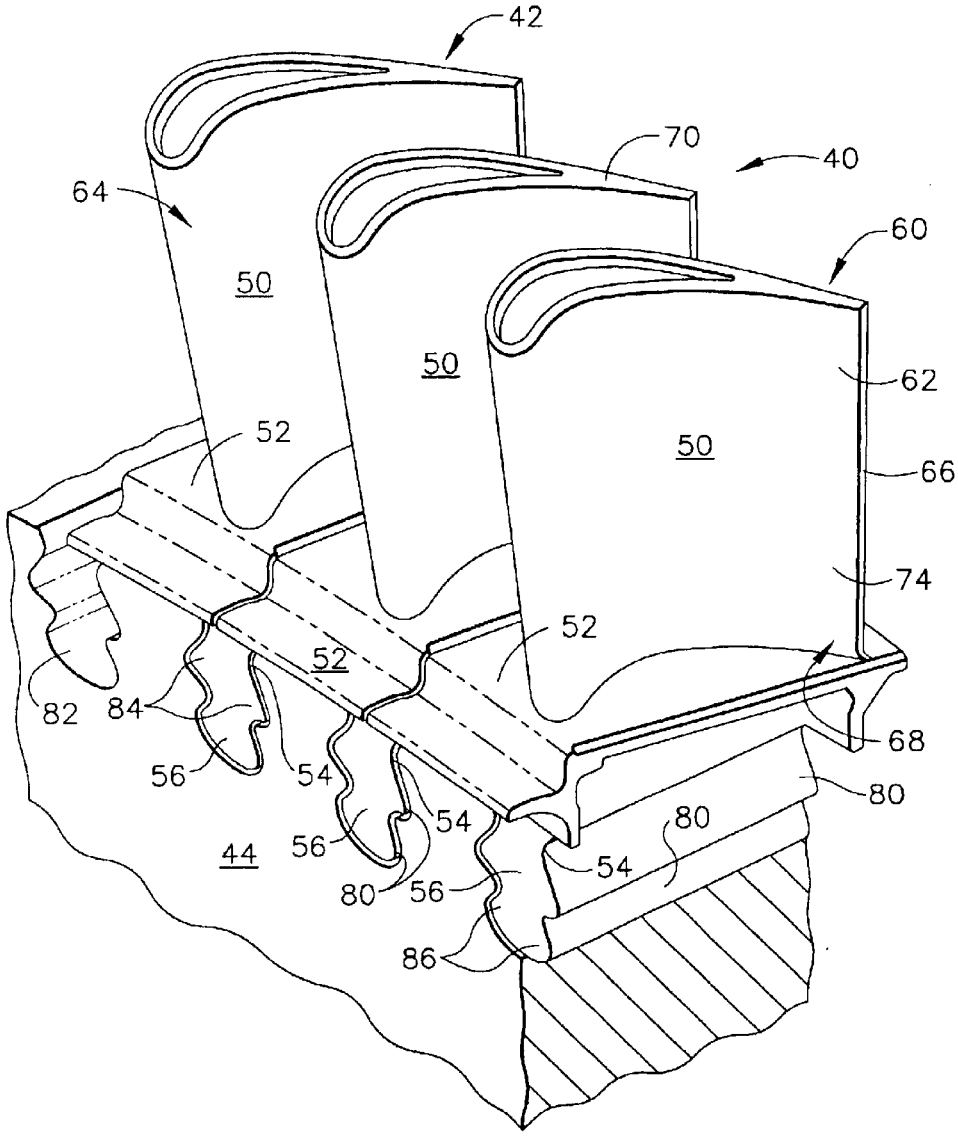
FIG. 2 is a perspective view of a turbine rotor assembly that may be used with the gas turbine engine shown in FIG. 1.

FIG. 2 is a perspective view of a rotor assembly 40 that may be used with a gas turbine engine, such as gas turbine engine 10 (shown in FIG. 1). Assembly 40 includes a plurality of rotor blades 42 mounted within a rotor disk 44. In one embodiment, blades 42 form a high-pressure turbine rotor blade stage (not shown) of gas turbine engine 10.

Rotor blades 42 extend radially outward from rotor disk 44, and each includes an airfoil 50, a platform 52, a shank 54, and a dovetail 56. Each airfoil 50 includes first sidewall 60 and a second sidewall 62. First sidewall 60 is convex and defines a suction side of airfoil 50, and second sidewall 62 is concave and defines a pressure side of airfoil 50. Sidewalls 60 and 62 are joined at a leading edge 64 and at an axially-spaced trailing edge 66 of airfoil 50. More specifically, airfoil trailing edge 66 is spaced chord-wise and downstream from airfoil leading edge 64.

First and second sidewalls 60 and 62, respectively, extend longitudinally or radially outward in span from a blade root 68 positioned adjacent platform 52, to an airfoil tip 70. Airfoil tip 70 defines a radially outer boundary of an internal cooling chamber (not shown in FIG. 2). The cooling chamber is bounded within airfoil 50 between sidewalls 60 and 62, and extends through platform 52 and through shank 54 and into dovetail 56. More specifically, airfoil 50 includes an inner surface (not shown in FIG. 2) and an outer surface 74, and the cooling chamber is defined by the airfoil inner surface.

Platform 52 extends between airfoil 50 and shank 54 such that each airfoil 50 extends radially outward from each respective platform 52. Shank 54 extends radially inwardly from platform 52 to dovetail 56. Dovetail 56 extends radially inwardly from shank 54 and facilitates securing rotor blade 42 to rotor disk 44. More specifically, each dovetail 56 includes at least one tang 80 that extends radially outwardly from dovetail 56 and facilitates mounting each dovetail 56 in a respective dovetail slot 82. In the exemplary embodiment, dovetail 56 includes an upper pair of blade tangs 84, and a lower pair of blade tangs 86.

Figure 3:
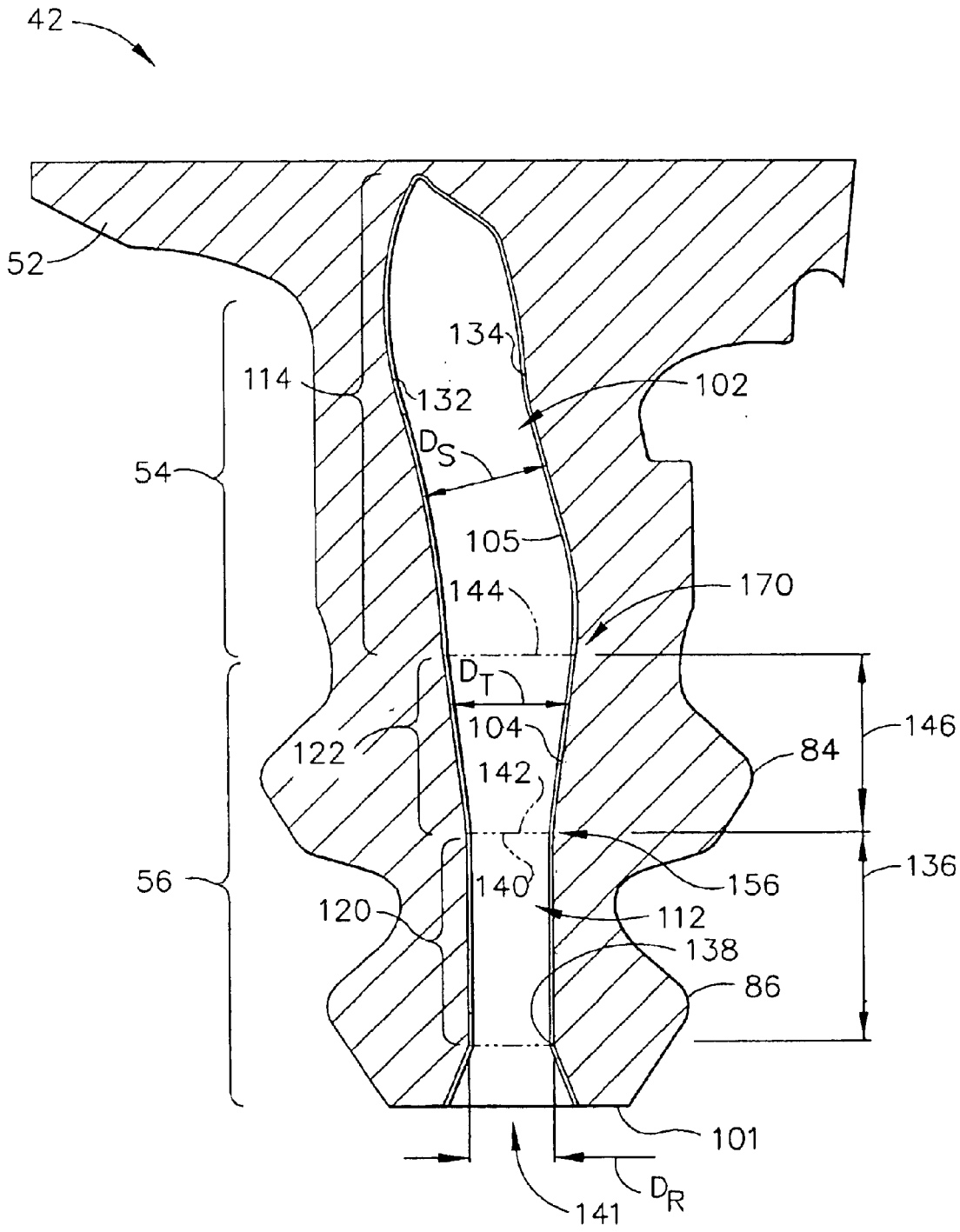
FIG. 3 is an exemplary cross-sectional side view of a rotor blade that may be used with the rotor assembly shown in FIG. 2.
Figure 4:
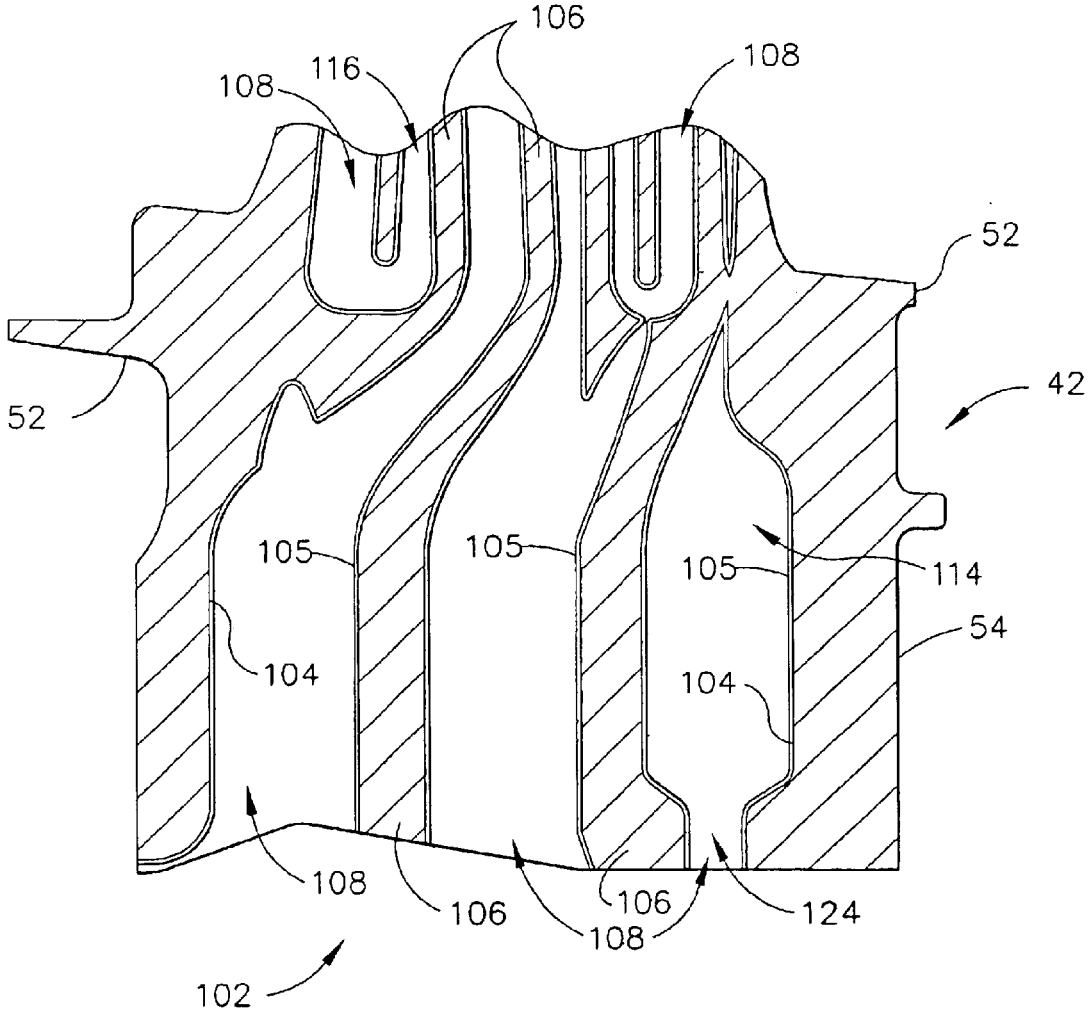
FIG. 4 is an exemplary cross-sectional front view of the rotor blade shown in FIG. 3.
Figure 5:
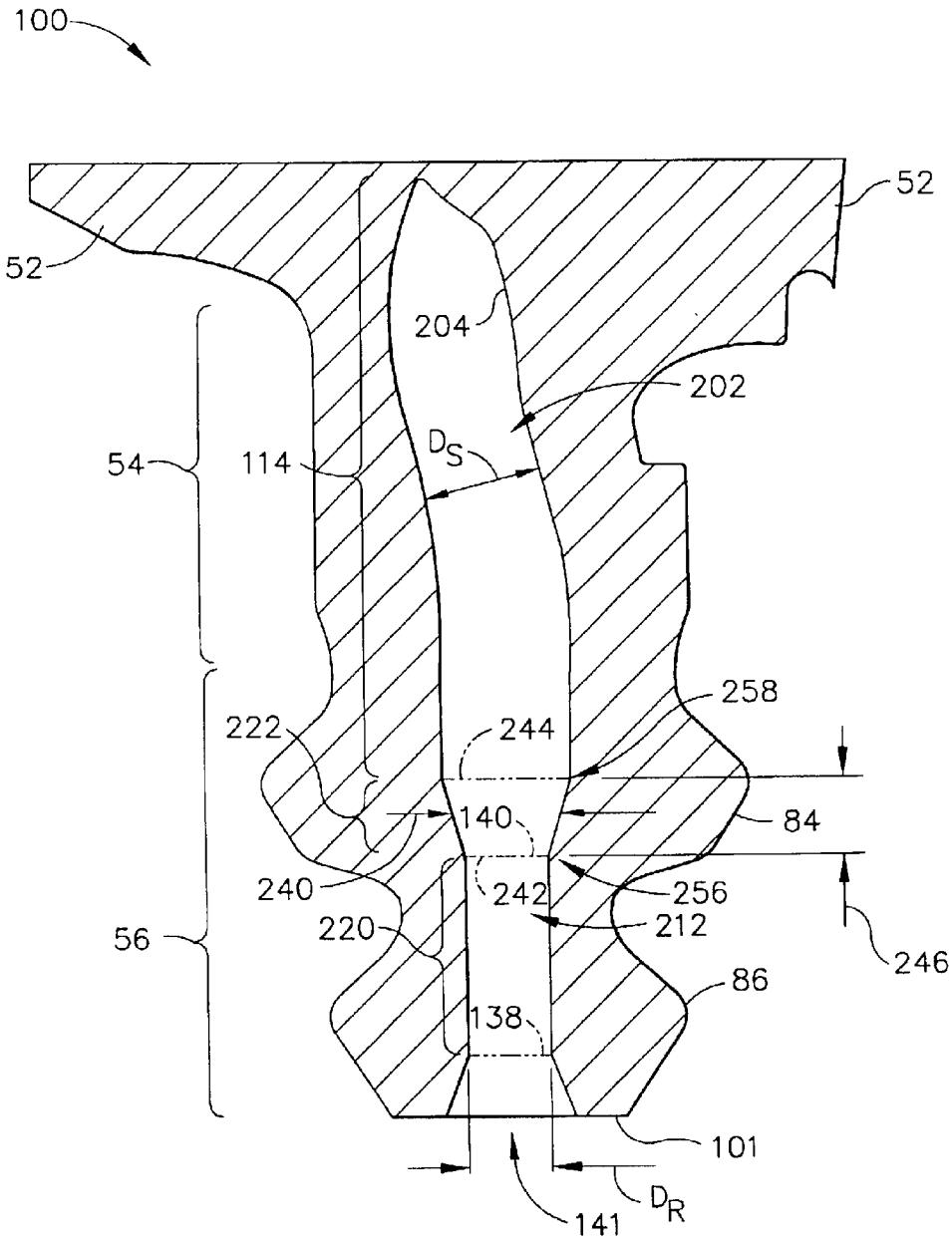
FIG. 5 (PRIOR ART)
FIG. 5 is an exemplary cross-sectional front view of a portion of a known rotor blade.

FIG. 3 is an exemplary partial leading edge cross-sectional view of rotor blade 42. FIG. 4 is an exemplary partial side cross-sectional view of rotor blade 42. FIG. 5 is an exemplary side cross-sectional view of a portion of a known rotor blade 100. Each blade 42 includes platform 52, shank 54, and dovetail 56. As described above, shank 54 extends between platform 52 and dovetail 56, and dovetail 56 extends radially inwardly from shank 54 to a radially inner end 101 of blade 42. Platform 52, shank 54, dovetail 56, and airfoil 50 are hollow, and define a cooling cavity 102 that extends therethrough. More specifically, cooling cavity 102 is bounded within rotor blade 42 by an inner surface 104 of blade 42. Cooling cavity 102 includes a plurality of inner walls 106 which partition cooling cavity 102 into a plurality of cooling chambers 108. The geometry and interrelationship of chambers 108 to walls 106 varies with the intended use of blade 42. In one embodiment, inner walls 106 are cast integrally with airfoil 50.

Blade cooling cavity 102 also includes a dovetail portion 112, a shank portion 114, and an airfoil portion 116 coupled together in flow communication such that cooling fluid supplied to cooling cavity dovetail portion 112 is routed through portions 112 and 114 and into cooling cavity airfoil portion 116. Cooling cavity dovetail portion 112 includes a root passage section 120 and a transition passage section 122 coupled in flow communication. More specifically, root passage section 120 includes a plurality of root passages 124 that extend between blade end 101 and transition passage section 122, and transition passage section 122 extends between root passage section 120 and shank portion 114.

Root passage section 120 has a substantially constant width $D_R$ measured between a suction sidewall 132 and a pressure sidewall 134 of cooling cavity 102. More specifically, width $D_R$ is substantially constant for a length 136 measured between a radially inner end 138 of root passage section 120 and a radially outer end 140 of root passage section 120. Root passage section radially inner end 138 is adjacent a cooling cavity throat 141 and root passage section radially outer end 140 is adjacent transition passage section 122. Cooling cavity throat 141 is defined at blade end 101 between lower blade tangs 86, and root passage section radially outer end 140 is defined between upper blade tangs 84. Accordingly, sidewalls 132 and 134 are substantially parallel within root passage section 120.

Transition passage section 122 gradually tapers outwardly from root passage section 120 to cooling cavity shank portion 114, which has a width $D_S$ that is larger than root passage section width $D_R$. Accordingly, a width $D_T$ of transition passage section 122 is variable between a radially inner end 142 and a radially outer end 144 of transition passage section 122. Variable transition passage section width $D_T$ is larger than root passage section width $D_R$ through transition passage section 122, and is equal shank portion width $D_S$ at transition passage radially outer end 144. Transition passage section 122 has a length 146 measured between measured between transition passage section ends 142 and 144. More specifically, the combination of transition passage section length 146 and an arcuate interface 156, formed with a pre-defined radius and defined between transition passage section 122 and root section passage 120, enables transition passage section 122 to taper gradually outward between root section 120 and shank portion 114. Furthermore, transition passage section length 146 enables an arcuate interface 170 to be defined between transition passage section 122 and shank portion 114.

Rotor blade 100 is known and is substantially similar to blade 42. Accordingly, blade 100 includes platform 52, shank 54, and dovetail 56. Additionally, blade 100 includes a cooling cavity 202 that is substantially similar to cooling cavity 102, and is bounded by an inner surface 204 of blade 100. Blade cooling cavity 202 also includes airfoil portion 116, a dovetail portion 212, and shank portion 114 coupled together in flow communication such that cooling fluid supplied to cooling cavity dovetail portion 212 is routed through portions 212 and 114 into cooling cavity airfoil portion 116. Cooling cavity dovetail portion 212 includes a root passage section 220 and a transition passage section 222 coupled in flow communication. More specifically, root passage section 220 extends between blade end 101 and transition passage section 222, and transition passage section 222 extends between root passage section 220 and shank portion 114.

Root passage section radially inner end 138 is adjacent cooling cavity throat 141 and root passage section radially outer end 140 is adjacent transition passage section 222.

Cooling cavity throat 141 is defined at blade end 101 between lower blade tangs 86, and root passage section radially outer end 140 is defined between upper blade tangs 84.

Transition passage section 222 expands outwardly from root passage section 220 to cooling cavity shank portion 114. Accordingly, a width 240 of transition passage section 222 is variable between a radially inner end 242 and a radially outer end 244 of transition passage section 222. Transition passage section width 240 is larger than root passage section width $D_R$. Transition passage section 222 has a length 246 measured between measured between transition passage section ends 242 and 244. Because length 246 is less than transition passage length 146, transition passage section 222 expands abruptly outwardly from root passage section 222 to shank portion 114, such that transition passage section width 240 is equal to shank portion width $D_S$ at transition passage section end 244. As a result of the abrupt transition, a lower corner 256 is formed between transition passage section 222 and root passage section 220, and an upper corner 258 is formed between transition passage section 222 and shank portion 114. Furthermore, because length 246 is less than transition passage length 146, upper corner 258 is defined between upper blade tangs 84.

During fabrication of blade 42, airfoil inner surface 104 is coated with a layer of an oxidation resistive environmental coating 105. In one embodiment, oxidation resistive environmental coating 105 is an aluminide coating commercially available from Howmet Thermatech, Whitehall, Mich. In the exemplary embodiment, oxidation resistive environmental coating 105 is applied to airfoil inner surface by a vapor phase aluminide deposition process. The combination of arcuate interfaces 156 and 170, and transition passage section 122 enable oxidation resistive environmental coating 105 to be applied at thickness' that are greater than those acceptable within blade 100. Specifically, within blade 100 it is known to limit the thickness of environmental coating to less than 0.001 inches. However, within blade 42, coating 105 may be applied to a thickness of 0.015 inches. The increased thickness enables manufacturing coating controls that are used to limit a thickness of coating 105 applied to blade 100 to be reduced within blade 42, such that an overall manufacturing cost of blade 42 is reduced in comparison to blade 100.

During fabrication of cavity 102, a core (not shown) is cast into blade 42. The core is fabricated by injecting a liquid ceramic and graphite slurry into a core die (not shown). The slurry is heated to form a solid ceramic airfoil core. The airfoil core is suspended in an airfoil die (not shown) and hot wax is injected into the airfoil die to surround the ceramic airfoil core. The hot wax solidifies and forms an airfoil (not shown) with the ceramic core suspended in the airfoil.

The wax airfoil with the ceramic core is then dipped in a ceramic slurry and allowed to dry. This procedure is repeated several times such that a shell is formed over the wax airfoil. The wax is then melted out of the shell leaving a mold with a core suspended inside, and into which molten metal is poured. After the metal has solidified the shell is broken away and the core removed.

During engine operation, cooling fluid is supplied into blade 42 through cooling cavity root passage section 120. In one embodiment, the cooling fluid is supplied to blade 42 from a compressor, such as compressor 14 (shown in FIG. 1). Cooling fluid entering blade dovetail 56 is channeled through root passage section 122 and through transition passage section 122 into cooling cavity shank portion 122. The cooling fluid is then channeled into cooling chambers 108 defined within cooling cavity airfoil portion 116. As hot combustion gases impinge upon blade 42, an operating temperature of blade internal surface 104. The oxidation resistive environmental coating facilitates reducing oxidation of blade internal surface 104 despite the increased operating temperature.

Furthermore, during operation, stresses generated during engine operation may induced into blade dovetail 56. The increased thickness of the oxidation resistive environmental coating within blade 42 as compared to blade 100 facilitates preventing material degradation within blade dovetail 56, thereby maintaining a fatigue life of blade 42. More specifically, arcuate interfaces 156 and 170 facilitate limiting cracking of the oxidation resistive environmental coating within blade dovetail 56 and, thus, extends a useful life of blade 42. Furthermore, during operation, arcuate interfaces 156 and 170 facilitate reducing operating stresses that may be induced into dovetail 56 in comparison to corners 256 and 258 of blade 100, and thus also facilitates extending a useful life of blade 42.

The above-described blade is cost-effective and highly reliable. The blade includes a cooling cavity defined at least partially within a dovetail portion of the blade. The cooling cavity defined within the dovetail includes arcuate transitions between the various portions of the cooling cavity. The arcuate transitions facilitate reducing operating stresses that may be induced into the dovetail in comparison to known rotor blades. Additionally, the arcuate transitions enable a thicker layer of oxidation resistive environmental coating to be applied to an inner surface of the blade in comparison to known blades. The arcuate transitions facilitate reduced cracking of the thicker layer of coating within the blade dovetail. As a result, the geometry design of the blade, in combination with the environmental coating, facilitates maintaining thermal fatigue life and extending a useful life of the airfoil in a cost-effective and reliable manner.

While the invention has been described in terms of various specific embodiments, those skilled in the art will recognize that the invention can be practiced with modification within the spirit and scope of the claims.

What is claimed is:

1. A method for manufacturing a blade for a gas turbine engine, wherein the blade includes an airfoil, a platform, a shank, and a dovetail, the platform extending between the airfoil and the shank, the shank extending between the dovetail and the platform, the dovetail including at least one tang for securing the blade within the engine, said method comprising:

defining a cooling cavity in the blade that extends through the airfoil the platform, the shank, and the dovetail, wherein the portion of the cavity defined within the dovetail includes a root passage portion having a first width, and a transition portion that extends between the root passage and the portion of the cavity defined within the shank, and wherein the portion of the cavity defined within the shank has a second width that is larger than the root passage first width; and coating at least a portion of an inner surface of the blade that defines the cooling cavity with a layer of an oxidation resistant environmental coating, such that at least a portion of the inner surface of the cooling cavity within the dovetail is coated with a coating having a thickness greater than 0.001 inches to facilitate reducing life cycle fatigue cracking within the dovetail.

2. A method in accordance with claim 1 wherein said defining a cooling cavity further comprises defining the cooling cavity within the dovetail such that the root passage first width is substantially constant within the root passage, and such that the transition portion is tapered between the root passage and the portion of the cavity defined within the shank, such that a width of the transition portion is variable within the transition portion.

3. A method in accordance with claim 2 wherein said defining a cooling cavity further comprises defining the cooling cavity such that an interface between the dovetail transition portion and the shank portion forms an arcuate shape that defines a portion of the cooling cavity.

4. A blade for a gas turbine engine, said blade comprising:

a platform;

a shank extending from said platform;

a dovetail extending between an end of said blade and said shank for mounting said blade within the gas turbine engine, said dovetail comprising at least one tang;

an airfoil comprising a first sidewall and a second sidewall extending in radial span between said platform and a blade tip; and a cooling cavity defined within said blade by said dovetail, said shank, said platform, and said airfoil, said cooling cavity comprising a dovetail portion defined within said dovetail, a shank portion defined within said shank and said platform, and an airfoil portion defined within said airfoil, said shank portion coupled in flow communication between said airfoil portion and said dovetail portion, said dovetail portion comprising a root passage and a transition passage, said root passage comprising a first width, said shank portion comprising a second width larger than said root passage first width, said transition passage coupled between said root passage and said shank portion, said dovetail further comprises an inner surface defining said cooling cavity dovetail portion, said dovetail inner surface coated with an oxidation resistant environmental coating having a thickness greater than 0.001 inches, such that said cooling cavity dovetail portion facilitates reducing dovetail low cycle fatigue cracking.

5. A blade in accordance with claim 4 wherein said cooling cavity root passage first width measured between a pressure side of said cooling cavity and a suction side of said cooling cavity, said root passage first width substantially constant within said root passage.

6. A blade in accordance with claim 4 wherein said cooling cavity shank passage second width measured between a pressure side of said cooling cavity and a suction side of said cooling cavity, an interface of said transition passage and said shank portion is arcuate.

7. A blade in accordance with claim 6 wherein said cooling cavity interface facilitates reducing operating stresses induced within said blade dovetail.

8. A gas turbine engine comprising a plurality of blades, each said blade comprising an airfoil, a shank, and a platform extending therebetween, each said blade further comprising a cooling cavity, and a dovetail comprising at least one tang and configured to secure each said blade within said engine, said shank extending between said platform and said dovetail, said cooling cavity defined within said airfoil, said platform, said shank, and said dovetail, said cooling cavity comprising a dovetail portion, a shank portion, and an airfoil portion coupled in flow communication, said cooling cavity dovetail portion comprising a root passage comprising a first width, and a transition passage, said cooling cavity shank portion comprising a second width that is larger than said root passage first width, said cooling cavity transition passage tapering between said root passage and said shank portion, at least a portion of said cooling cavity is coated with an oxidation resistant environmental coating having a thickness greater than 0.001 inches such that said cooling cavity facilitates reducing dovetail low cycle fatigue cracking.

9. A gas turbine engine in accordance with claim 8 wherein said cooling cavity root passage first width measured between a pressure side and a suction side of said cooling cavity, said cooling cavity shank portion second width is measured between said cooling cavity pressure and suction sides, said root passage first width is substantially constant within said root passage.

10. A gas turbine engine in accordance with claim 9 wherein an interface between said cooling cavity transition passage and said cooling cavity shank portion forms a radius.

11. A gas turbine engine in accordance with claim 9 wherein said cooling cavity coated with an oxidation resistant environmental coating having a thickness configured to reduce low cycle fatigue of each said blade.

12. A gas turbine engine in accordance with claim 9 wherein at least a portion of said cooling cavity dovetail portion is coated with an oxidation resistant environmental coating having a thickness greater than 0.001 inches.

13. A gas turbine engine in accordance with claim 9 wherein each said cooling cavity facilitates reducing operating stresses induced within each said blade dovetail.

* * * * *